US008537065B2

(12) United States Patent
Minard et al.

(10) Patent No.: US 8,537,065 B2
(45) Date of Patent: Sep. 17, 2013

(54) SYSTEM OF TWO ANTENNAS ON A SUPPORT

(75) Inventors: Philippe Minard, Saint Medard sur Ille (FR); Jean-Yves Le Naour, Pace (FR); Philippe Chambelin, Chateaugiron (FR); Jean-Luc Robert, Betton (FR)

(73) Assignee: Thomson Licensing, Issy les Moulineaux (FR)

( * ) Notice: Subject to any disclaimer, the term of this patent is extended or adjusted under 35 U.S.C. 154(b) by 0 days.

(21) Appl. No.: 12/734,535

(22) PCT Filed: Nov. 7, 2008

(86) PCT No.: PCT/EP2008/065181

§ 371 (c)(1),
(2), (4) Date: Apr. 13, 2011

(87) PCT Pub. No.: WO2009/060088

PCT Pub. Date: May 14, 2009

(65) Prior Publication Data

US 2011/0187619 A1 Aug. 4, 2011

(30) Foreign Application Priority Data

Nov. 9, 2007 (FR) ..... 07 58925

(51) Int. Cl.
*H01Q 13/10* (2006.01)

(52) U.S. Cl.
USPC ..... 343/770; 343/879

(58) Field of Classification Search
USPC ..... 343/770, 879, 767
See application file for complete search history.

(56) References Cited

U.S. PATENT DOCUMENTS

2006/0181468 A1 8/2006 Iguchi et al.
2008/0231532 A1 * 9/2008 Rao et al. ..... 343/770

FOREIGN PATENT DOCUMENTS

GB 453759 9/1936
WO WO 2007/063066 6/2007
WO WO2007/063066 * 6/2007
WO WO 2007063066 A1 * 6/2007

OTHER PUBLICATIONS

The ARRL Antenna Book by American Radio Relay League (1988).*
A. Diallo et al: "Study and Reduction of the Mutual Coupling Between Two Mobile Phone PIFAs Operating in the DCS1800 and UMTS Bands", IEEE Transactions on Antennas and Propagation, vol. 55, No. 11, Nov. 2006, pp. 3063-3074.
Search Report Dated Mar. 25, 2009.

* cited by examiner

*Primary Examiner* — Douglas W Owens
*Assistant Examiner* — Collin Dawkins
(74) *Attorney, Agent, or Firm* — Tutunjian & Bitetto, P.C.

(57) ABSTRACT

The invention concerns a system of antennas on the same support. Each antenna is connected to a first port for the emission/reception in a first frequency band, and to a second port for the emission/reception in a second frequency band. The invention consists in a specific dimensioning of the support, such that the difference of the perimetric lengths separating the median points is a function of the half wavelength $\lambda/2$ modulo $k\lambda$, k positive integer, where $\lambda$ is the wavelength corresponding to a working frequency fr.

2 Claims, 4 Drawing Sheets

SYSTEM OF TWO ANTENNAS ON A SUPPORT

Figure 1:
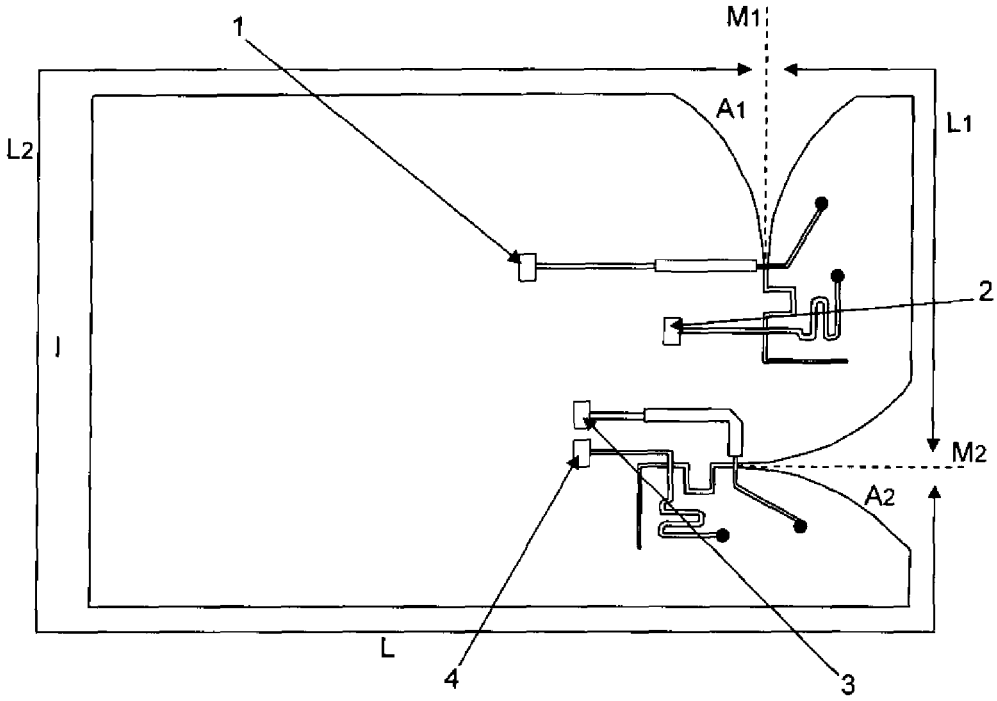

This application claims the benefit, under 35 U.S.C. §365 of International Application PCT/EP2008/065181, filed Nov. 7, 2008, which was published in accordance with PCT Article 21(2) on May 14, 2009 in English and which claims the benefit of French patent application No. 0758925, filed Nov. 9, 2007.

The present invention relates to a system of two longitudinal radiation antennas located on the same support.

This invention is situated within the development framework of WIFI ports that is currently evolving toward dual band 2.4 GHz (standard 802.11b/g) and 5 GHz (standard 802.11a) systems.

For indoor wireless communications, the phenomenon of multiple paths is extremely penalising. Diversity techniques implemented in WIFI devices consist in switching between two reception antennas in such a manner as to choose the best. In the case of spatial diversity, the antennas can be spaced at a distance. In the case of polarisation diversity, the antennas have orthogonal polarisations and in the case of radiation diversity, they have complementary radiation diagrams. Through these diversities, the 2 antennas are decorrelated.

Hence, dual band wireless systems (802.11a/b/g) with diversity are implemented in products such as ADSL modems or PCMCIA boards.

The patent application FR0512148 describes such an antenna system composed of two printed longitudinal radiation antennas operating at 2.4 GHz and 5 GHz, and having per antenna two separate access for each frequency. The antennas are printed on a same substrate. The printed antennas are sufficiently distant from each other to produce an isolation between antennas. Now, faced with the compactness constraint of the system, the antennas A1 and A2 are close to one another and their level of isolation decreases.

If the isolation between the emission/reception channels is to low, their are significant disturbances due to the interferents. It is possible for this to result in a saturation risk of the reception channel and an oscillation risk of the power amplification of the emission channel that create a malfunction of the system.

The solutions typically used to increase the isolation in a frequency band between antennas are:

1—increasing the distance of the antennas: this solution has been described above, 2—use of high impedance surfaces or photonic band gap structures (PBG), 3—the addition of an etched slot between the two antennas in the ground plane covering the substrate. The patent application FR0552194 describes such a method for isolating 2 antennas etched in the ground plane covering the substrate. The substrate also integrates the RF function circuits associated with the 2 antennas.

The U.S. Pat. No. 6,549,170 also describes a solution wherein a protuberant metal ground plane is introduced between two slot antennas.

Now, when it is attempted to bring the antennas closer together, the isolation between the antennas of an emission/reception system becomes insufficient.

The invention therefore relates to a two antenna system comprising on a same support:

a first antenna connected to a first port for the emission/reception in a first frequency band, and to a second port for the emission/reception in a second frequency band;

a second antenna connected to at least a third port for the emission/reception in the first frequency band and to a forth port for the emission/reception in a second frequency band identical to or different from the first, and, each antenna defines a first median point and a second median point by the projection of the geometric centre on the closest edge of the support, the first median point of the first antenna at the level of the perimeter of the support is distant by a perimetric length in one direction and by a perimetric length in the other direction, from the second median point of the second antenna, a specific dimensioning of the support is such than the difference L1–L2 of the lengths separating the median points is a function of the half wavelength $\lambda/2$ modulo 2 k $\lambda$, k positive integer, where $\lambda$ is the wavelength corresponding to an working frequency fr.

The invention has the advantage of enabling a significant isolation without providing external circuits such as filtering circuits.

Preferentially, the isolation between the antennas is complemented by at least one slot of length and width defined by the frequency to reject and realised between the two antennas on the shortest path (L1) dimensioned in such a manner as to bring a high impedance plane to the edge of the ground plane. Preferentially, the isolation between the antennas is complemented by at least one slot of length and width defined by the frequency to reject and realised between the two antennas on the longest path (L2) dimensioned in such a manner as to bring a high impedance plane to the edge of the ground plane.

Preferentially, the support is rectangular or the antennas are of diversity of order 2 or the antennas are bi-band.

Figure 2:
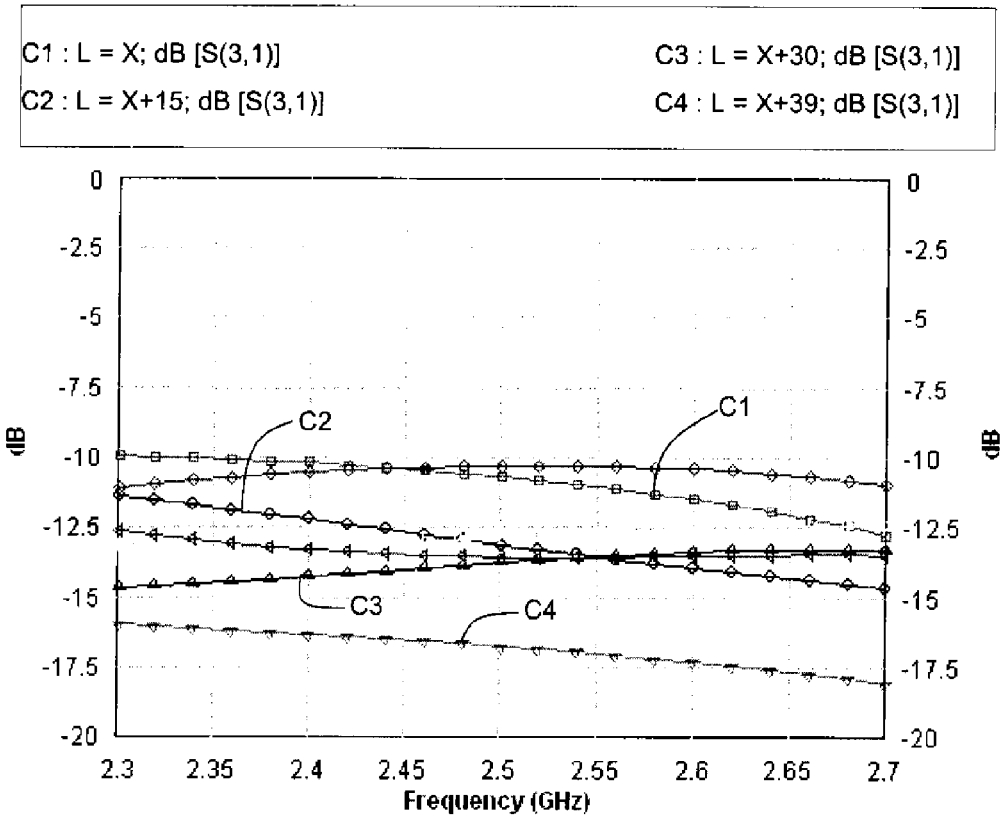

The characteristics and advantages of the aforementioned invention will emerge more clearly upon reading the following description made with reference to the drawings attached in the appendix, wherein:

FIG. 1 is an optimised configuration according to the invention with an optimum isolation between antennas within a certain frequency band, FIG. 2 corresponds to a first graph representing isolation curves between two ports of two antennas installed on the same substrate. These curves are given parameters according to the length of the substrate, for the frequencies of the 2.4 GHz band.

Figure 3:
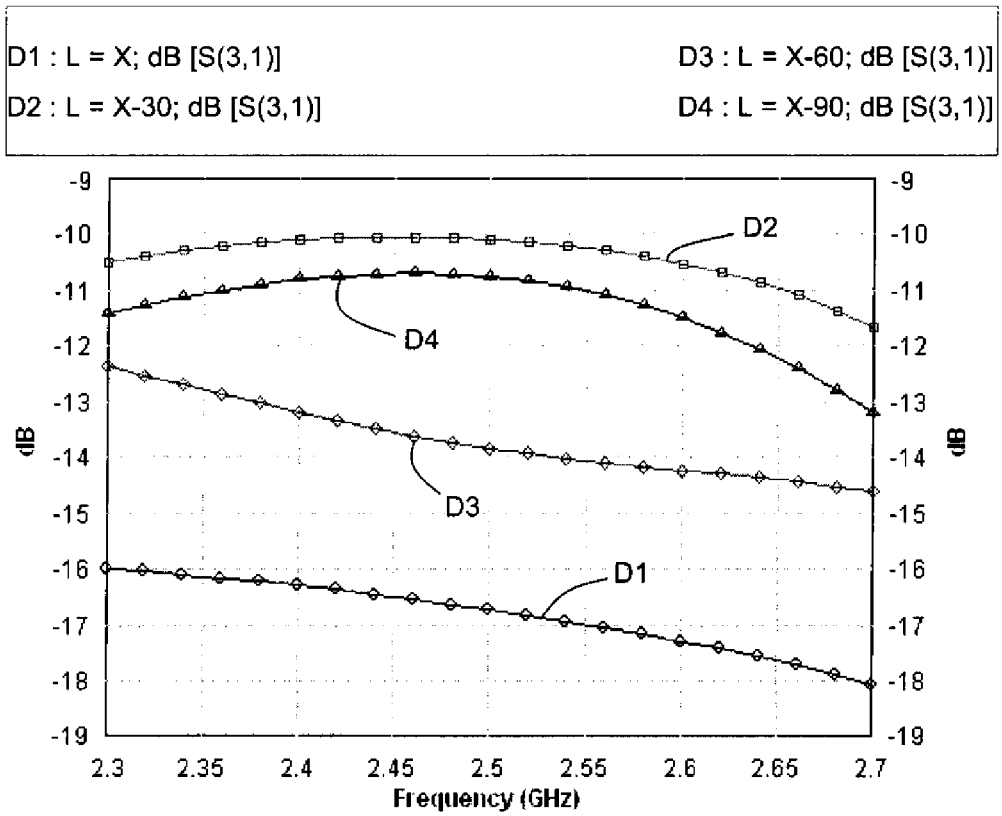

FIG. 3 corresponds to a first graph representing isolation curves between two ports of two antennas installed on the same substrate. These curves are given parameters according to the length of the substrate, for the frequencies of the 2.4 GHz band.

Figure 4:
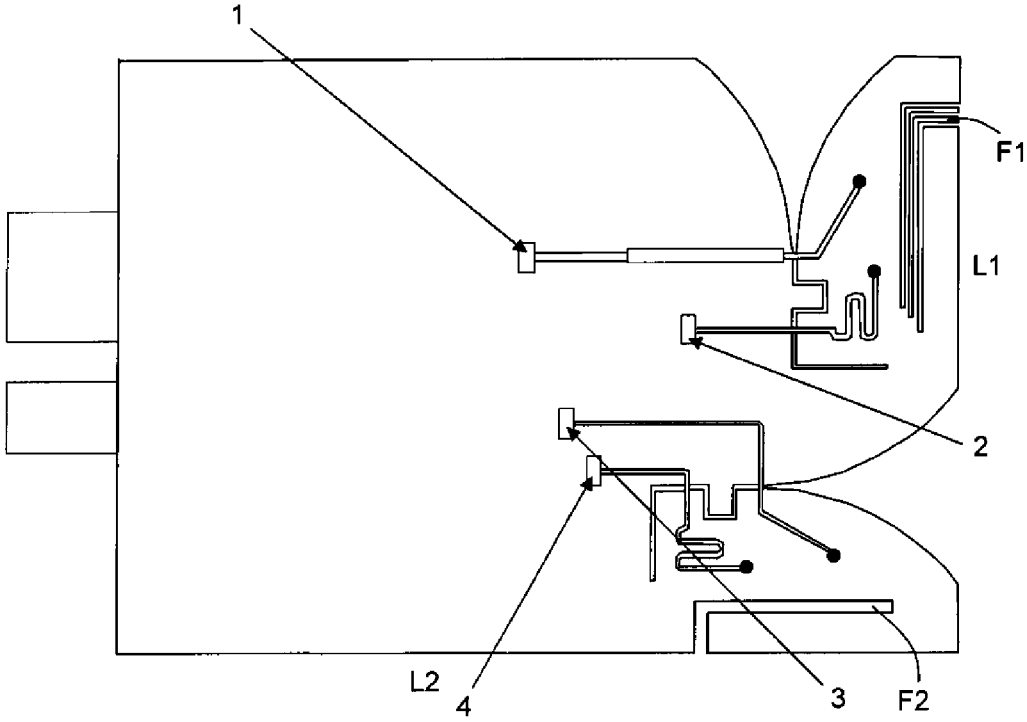

FIG. 4 corresponds to an optimised isolation configuration according to the invention due to the presence of slots between the antennas.

FIG. 1 shows a bi-band emission/reception system realised on a substrate. It preferably comprises a first bi-band antenna A1 with two ports enabling the transmission of signals in a first frequency band of the 2.4 GHz band on a first port 1 and the transmission of signals in a second frequency band of the 5 GHz band on a second port 2, a second bi-band antenna A2 enabling the transmission of signals in the first frequency band of the 2.4 GHz band on a third port 3 and the transmission of signals in the second frequency band of the 5 GHz band on a forth port 4.

The first antenna A1 corresponds to a first microstrip excitation line at the central frequency of the first frequency band and to a second microstrip excitation line at the central frequency of the second frequency band etched on one face of the substrate and coupled to the excitation slot line of the antenna on the opposite face of the substrate. The antenna features a tapered slot. The slot line thus terminates in an aperture of a conical form also etched in the ground plane.

For the coupling of the microstrip line to the slot line to be at a maximum, the two lines must be orthogonal between each other. Because, in the crossover plane, the magnetic field Hm of the microstrip line and the electrical field Es of the slot line are maximum. It therefore corresponds to a short-circuit plane for the microstrip line and to an open-circuit plane for the slot line at the coupling central frequency.

The second antenna A2 is formed in the same manner: it corresponds to a third microstrip excitation line at the central frequency of the first frequency band and to a fourth microstrip excitation line at the central frequency of the second frequency band that are etched onto one face of the substrate and coupled to the excitation line of the second tapered slot antenna. The slot line thus terminates in an aperture of a conical form etched on the opposite face in the ground plane.

These are tapered slot antennas (TSA), for example with a Vivaldi type profile (noticeably exponential profile).

The example describes the printed antennas. The invention also relates to all other types of longitudinal radiation antennas, to antennas using a ground plane such as for example monopole antennas, PIFA antennas.

The antennas to isolate can be of different types or of different applications (WIFI, Bluetooth, DECT, etc.) with a view to an isolation at a certain frequency. The antennas are for example arranged orthogonally. They could also be colinear with a position defined arbitrarily on the substrate.

The different ports are connected to a RF base circuit enabling the transmission of the signals to the RF reception or transmission circuits.

The apertures of the 2 conical shaped antennas, etched in the ground plane, have at the edge of the substrate a certain length corresponding to the aperture of the antenna. A median plane or geometric centre enables a first median point M1 to be defined, and a second median point M2 belonging to the periphery of the substrate and situated at an equal distance from the extremities of the aperture of a conical shaped antenna. The median points M1, M2 of each of the antennas are separated by a perimetric distance of L1 in one direction and by a perimetric distance L2 in the other direction.

The substrate is for example of a regular shape of length L and of width I. It can also have other forms favourable to the required system.

The invention is based on the following observation: the induced currents, generated by one antenna on each of the paths L1 and L2 along the ground plane, recombine.

Hence, for an optimum isolation at a certain working frequency fr, the induced currents generated by an antenna on each of the paths along the ground plane must recombine in phase opposition with the currents generated by the other antenna.

To combine in phase opposition, the difference of the length of the paths between the two antennas along the ground plane must be lambda/2 (modulo 2 lambda) where lambda is the wavelength corresponding to the working frequency fr in such a manner that the currents generated by an antenna on each of the paths along the ground plane combine in phase opposition with the currents generated by the second antenna, thus improving the isolation between antennas.

The method according to the invention thus consists in parameterising the lengths L1 and L2 in such a manner that the difference of these lengths is a multiple of $0.5\lambda$ mod $2\lambda$.

For technical realisation reasons, the more the substrate is dimensioned such that L2−L1 tends toward $0.5\lambda$, the greater the isolation at the working frequency.

For example, for a working frequency of 2.4 GHz, corresponding to a wavelength of 125 mm, and with L1=$1.03\lambda$ and L2=$0.53\lambda$, the difference between the lengths L2 and L1 of the substrate is equal to $(1.03-0.53)\lambda=0.5\lambda$, namely, approximately 60 mm, and the currents generated by the antennas are therefore in phase opposition.

The same reasoning applies if it is required to increase the 5 GHz isolation. Knowing the relationship between the values of L1 and L2, those skilled in the art can easily deduce mathematically the ratios between the different dimensions L and I of the substrate.

FIG. 2 shows the results obtained between the ports 1 and 3 corresponding to the transmission of the signals at the 2.4 GHz frequency for different lengths of the substrate.

The first curve C1 or reference curve corresponds to a basic length L, for example L=X≈70 mm, the width of the substrate I being fixed and for example at ≈45 mm. Thanks to this curve, it is possible to observe an isolation of −10 dB in the 2.4 GHz frequency band.

The second curve C2 corresponds to the basic length L increased by 15 mm, so L=X+1.5 cm.

Thanks to this curve, it is possible to observe an isolation of −12 dB at the frequency of 2.4 GHz.

The third curve C3 corresponds to the basic length L increased by 30 mm, so L=X+3 cm.

Thanks to this curve, it is possible to observe an isolation of −13 dB at the frequency of 2.4 GHz.

The fourth curve C4 corresponds to the basic length L increased by 39 mm, so L=X+3.9 cm.

Thanks to this curve, it is possible to observe an isolation of −16 dB at the frequency of 2.4 GHz.

Following the comparative study of these different curves, it appears that the isolation between the antennas 1 and 2 depends on the length of the substrate. It is at a maximum for an added value of 39 mm, namely a difference L2−L1≈60 mm, which corresponds to $0.5\lambda$.

FIG. 3 likewise represents the results obtained between the ports 1 and 3 corresponding to the emission and reception of signals at the 2.4 GHz frequency for different substrate lengths, these different lengths corresponding to differences between L1 and L2 of a multiple of $\lambda$.

Curve D1 corresponds to L1−L2≈$\lambda/2$, curve D2 to L1−L2≈$\lambda$, curve D3 to L1−L2≈$3\lambda/2$, curve D4 to L1−L2≈$2\lambda$.

FIG. 3 therefore shows isolations obtained from the optimum configuration (value 0) by which the ground plane was extended by lambda/2 (step of 60 mm). This figure clearly shows the periodicity of lambda for which the isolation is the best in the case where the dimensioning of the substrate is close to $\lambda/2+K\lambda$. Indeed, this optimisation enables an isolation of more than 16 dB to be reached. Depending on the selected dimensioning of the board, RF circuits and/or digital circuits could be added to the elements necessary for realising the antennas. Conversely, it is also possible to dimension the support substrate by a definite number of elements.

In a complementary manner and in the case where in spite of these isolation measures between the antennas, the isolation level is insufficient as the dimensions of the PCB board are imposed by dimension constraints for integrating the antenna function and the RF functions, an isolation by means of one or more slots arranged between the two antennas can be achieved.

FIG. 4 shows an antenna topology in which 3 slots are integrate between the two antennas on the path L1 and another slot on the path L2.

The slot(s) used have a width less than 1 mm and lengths preferentially of the order of lambda/4 where lambda is the guided wavelength in the slot at the working frequency. By their dimensioning, the slots thus bring a high impedance plane to the edge of the ground plane. In this manner, the currents generated by an antenna are attenuated on this path, improving the isolation with respect to the other antenna.

Each slot leading to an isolation at a certain frequency, the assembly of several slots leads to the isolation at the frequencies associated with the slots.

On boards of small size, the currents are also induced on the other path of the board. In the same manner, one or more slots can be placed along this path, in such a manner as to isolate the two antennas.

The positioning of these slots along the ground plane, together with their width, is determined by the impedance matching capacity of the antenna. This point can be highlighted by an electromagnetic simulator.

The use of one or more slots is related to the width of the required band and/or to the level of isolation required.

These techniques can therefore advantageously replace or complete known RF switch based devices. They can be implemented in series or parallel at the reception input so as not to saturate the reception channel and limit the interference signal power re-injected at the input of the power amplifier.

The invention claimed is:

1. An antenna system comprising on a same support:

a first longitudinal radiation antenna connected to a first port for the emission/reception in a first frequency band, and to a second port for the emission/reception in a second frequency band; and a second longitudinal radiation antenna connected to at least a third port for the emission/reception in the first frequency band and to a forth port for the emission/reception in the second frequency band identical to or different from the first, a first median point and a second median point being defined by the projection of the geometric center of the first longitudinal radiation antenna and the second longitudinal radiation antenna on edges of the support, the first median point of the first longitudinal radiation antenna is distant from the second medial point of the second longitudinal radiation antenna by a perimetric length in one direction and of a perimetric length in the other direction, wherein a specific dimensioning of a rectangular support is such that the difference of the perimetric lengths is a multiple of 0.5 $\lambda$ mod 2 $\lambda$, where $\lambda$ is the wavelength corresponding to a working frequency fr.

2. The Antenna system according to claim 1, wherein the isolation between the antennas is complemented by at least one slot of length and width defined by the frequency to be rejected and realized between the two antennas, either on the shortest path, or on the longest path, such as to bring a high impedance plane to the edge of the ground plane.

* * * * *